US005723242A

United States Patent [19]

Woo et al.

[11] Patent Number: 5,723,242

[45] Date of Patent: Mar. 3, 1998

[54] PERFLUOROETHER RELEASE COATINGS FOR ORGANIC PHOTORECEPTORS

[75] Inventors: Edward J. Woo, Woodbury; Gaye K. Lehman, Lauderdale, both of Minn.

[73] Assignee: Minnesota Mining and Manufacturing Company, St. Paul, Minn.

[21] Appl. No.: 896,857

[22] Filed: Jul. 18, 1997

Related U.S. Application Data

[63] Continuation of Ser. No. 623,590, Mar. 28, 1996, abandoned.

[51] Int. Cl.[6] ..... G03G 5/147

[52] U.S. Cl. ..... 430/66; 430/58; 430/67

[58] Field of Search ..... 430/66, 67

[56] References Cited

U.S. PATENT DOCUMENTS

| | | | |
|---|---|---|---|
| 4,600,673 | 7/1986 | Hendrickson et al. | 430/66 |
| 4,996,125 | 2/1991 | Sakaguchi et al. | 430/66 |
| 4,997,738 | 3/1991 | Kumakura et al. | 430/67 |
| 5,073,466 | 12/1991 | Ishikawa et al. | 430/66 |
| 5,124,220 | 6/1992 | Brown et al. | 430/67 |
| 5,342,718 | 8/1994 | Nuosho et al. | 430/67 |

FOREIGN PATENT DOCUMENTS

| | | |
|---|---|---|
| 0 361 346 | 4/1990 | European Pat. Off. . |
| 0 389 193 | 9/1990 | European Pat. Off. . |

*Primary Examiner*—Roland Martin
*Attorney, Agent, or Firm*—Susan Moeller Zerull

[57] ABSTRACT

This invention is a photoconductive element comprising an electroconductive substrate, a photoconductive layer on a surface of the electroconductive substrate, and a release layer over the photoconductive layer. The release layer comprises a fluoroether polymer which is the reaction product of components comprising: A) a di-functional perfluoroether, B) a diisocyanate, C) an amino functional silane, and D) optionally, a diol chain extender.

15 Claims, No Drawings

PERFLUOROETHER RELEASE COATINGS FOR ORGANIC PHOTORECEPTORS

This is a continuation of application Ser. No. 08/623,590 filed Mar. 28, 1996, now abandoned.

FIELD OF THE INVENTION

The present invention relates to a photoreceptor element which is capable of transferring toner images to a receptor. More specifically, this invention relates to a release coating for the photoreceptor element.

BACKGROUND OF THE INVENTION

Electrophotography forms the technical basis for various well known imaging processes, including photocopying and laser printing. The basic electrophotographic process involves placing a uniform electrostatic charge on a photoreceptor element; imagewise exposing the photoreceptor element to light, thereby dissipating the charge in the exposed areas; developing the resulting electrostatic latent image with a toner; and transferring the toner image from the photoreceptor element to a final substrate, such as paper or film, either by direct transfer or via an intermediate transfer material.

The structure of photoreceptor element may be a flat plate, a rotatable drum, or a continuous belt which is supported and circulated by rollers. All photoreceptor elements have a photoconductive layer which conducts electric current only when it is being exposed to light. The photoconductive layer is generally affixed to an electroconductive support. The surface of the photoconductor is either negatively or positively charged such that when light strikes the photoconductive layer, charge is conducted through the photoconductor in that region to neutralize the surface potential in the illuminated region. An optional barrier layer may be used over the photoconductive layer to protect the photoconductive layer and extend the service life of the photoconductive layer.

Typically, a positively charged toner is attracted to those areas of the photoreceptor element which retain a charge after the imagewise exposure, thereby forming a toner image which corresponds to the electrostatic latent image. The toner need not be positively charged. Some toners are attracted to the areas of the photoconductor element where the charge has been dissipated. The toner may be either a powdered material comprising a blend of polymer and colored particulates, typically carbon, or a liquid material of finely divided solids dispersed in an insulating liquid. Liquid toners are often preferable because they are capable of giving higher resolution images.

The toner image may be transferred to the substrate or an intermediate carrier by means of heat, pressure, a combination of heat and pressure, or electrostatic assist. A common problem that arises at this stage of electrophotographic imaging is poor transfer from the photoconductor to the receptor or intermediate carrier. Poor transfer may be manifested by low transfer efficiency and low image resolution. Low transfer efficiency results in images that are light and/or speckled. Low image resolution results in images that are fuzzy. These transfer problems may be alleviated by the use of a release coating.

The release layer is applied over the photoconductive layer or over the barrier layer if a barrier layer is being used. The release layer must adhere well to the photoconductive or barrier layer without the need for adhesives. Moreover, the release layer must not significantly interfere with the charge transport characteristics of the photoconductor construction.

Typical release coatings known in the electrophotographic arts include silicone polymers such as those disclosed in U.S. Pat. No. 4,600,673. Conventional silicone polymer release materials tend to swell significantly in the hydrocarbon solvents which are used as carrier liquids in electrophotography. Swollen polymers generally have reduced toughness, and siloxanes, which typically do not have good tensile properties, are very easily scratched when swollen.

Solvent resistance may be improved by adding fillers to or by cross-linking the polymer. However, cross-linked or filled systems tend to have increased the surface energy causing a decreased release performance.

U.S. Pat. No. 4,996,125 discloses the use of a perfluoroalkyl polyether and its derivatives as a lubricating layer. This patent includes an Example having a perfluoroether-urethane polymer lubricating layer on a electrophotographic photoreceptor. Images were made using a FX 4300 copier (Fuji Xerox Co., Ltd.), which is a copier that uses dry toner. However, when the present inventors tested similar release coatings with a liquid toner system, they found that such perfluoroether-urethane polymer release coats had poor resistance to liquid toner and a relatively high peel force.

Due to an increasing demand for more imaging cycles per photoreceptor element, a desire remains for a durable release layer with good release properties. Specifically, the release layer should be mechanically durable as to withstand abrasion of the various rollers and scrapers which contact the photoreceptor element. The release layer must also be resistant to the toner carrier liquids.

SUMMARY OF THE INVENTION

The present invention provides a photoreceptor element comprising an electroconductive substrate, a photoconductor layer, and a release layer which displays good release properties, as well as good durability and resistance to toner carrier liquids. The release layer comprises a perfluoroether urethane which includes silicon atoms (Si), via a silane group.

The release layer comprises a perfluoroether urethane which is the reaction product of a di-functional perfluoroether, a diisocyanate, an amino functional silane, and, optionally, a diol chain extender. Preferably, the perfluoroether urethane has the following structure:

$$C—[B—A—B—D]_x—[B—A]_y—B—C,$$

wherein A, B, C, and D are defined by the perfluoroether, the diisocyanate, the amino functional silane, and the diol chain extender, respectively; x is an integer from 0 to 10, and y is an integer from 1 to 10. Use of the diol chain extender, by having x greater than 1, is optional but preferred because it increases the resistance of the release layer to toner carrier liquids.

This release layer on an organic photoconductor has good toner release performance and good resistance to wiping, swelling and crazing with a toner carrier liquid. The perfluoroether urethane release coating can be used as a durable overcoat for an organic photoconductor used with liquid toners.

DETAILED DESCRIPTION OF THE INVENTION

The photoreceptor element of this invention comprises an electroconductive substrate which supports at least a photoconductor layer and a release layer. The photoconductors of this invention may be of a drum type construction, a belt construction, a flat plate, or any other construction known in the art.

Electroconductive substrates for photoconductive systems are well known in the art and are two general classes: (a) self-supporting layers or blocks of conducting metals, or other highly conducting materials; and (b) insulating materials such as polymer sheets, glass, or paper, to which a thin conductive coating, such as vapor coated aluminum, has been applied (e.g., aluminized polyethylene terephthalate).

The photoconductive layer can be any type known in the art, including an inorganic photoconductor material in particulate form dispersed in a binder or, more preferably, an organic photoconductor material. The thickness of the photoconductor layer is dependent on the material used, but is typically in the range of 5 to 150 μm.

Photoreceptor elements having organic photoconductor material are discussed in Borsenberger and Weiss, *Photoreceptors: Organic Photoconductors*, Ch. 9 Handbook of Imaging Materials, ed. Arthur S. Diamond, Marcel Dekker, Inc. 1991. When an organic photoconductor material is used, the photoconductive layer can be a bilayer construction consisting of a charge generating layer and a charge transport layer. The charge generating layer is typically about 0.01 to 20 μm thick and includes a material which is capable of absorbing light to generate charge carriers, such as a dyestuff or pigment. The charge transport layer is typically 10–20 μm thick and includes a material capable of transporting the generated charge carriers, such as poly-N-vinylcarbazoles or derivatives of bis-(benzocarbazole)-phenylmethane in a suitable binder.

In bilayer organic photoconductor layers in photoreceptor elements, the charge generation layer is typically located between the conductive substrate and the charge transport layer. Such a photoreceptor element is usually formed by coating the conductive substrate with a thin coating of a charge generation layer, overcoated by a relatively thick coating of a charge transport layer. During operation, the surface of the photoreceptor element is negatively charged. Upon imaging, in the light-struck areas, hole/electron pairs are formed at or near the charge generation layer/charge transport layer interface. Electrons migrate through the charge generation layer to the conductive substrate while holes migrate through the charge transport layer to neutralize the negative charge on the surface. In this way, charge is neutralized in the light-struck areas.

Alternatively, an inverted bilayer system may be used. Photoconductor elements having an inverted bilayer organic photoconductor material require positive charging which results in less deterioration of the photoreceptor surface. In an inverted bilayer system, the conductive substrate is coated with a relatively thick coating (preferably, 5–20μm) of a charge transport layer, overcoated with a relatively thin (preferably, 0.01 to 5 μm) coating of a charge generation layer. During operation, the surface of the photo-receptor is positively charged. Upon imaging, in the light-struck areas, hole/electron pairs are formed at or near the charge generation layer/charge transport layer interface. Electrons migrate through the charge generation layer to neutralize the positive charge on the surface while holes migrate through the charge transport layer to the conductive substrate. In this way, charge is again neutralized in the light-struck areas.

Single layer photoconductive layers are also common. In a single-layer construction, a mixture of charge generation and charge transport materials are incorporated into one layer. This layer has both charge generating and charge transport capabilities. Examples of single-layer organic photoconductive layers are described in U.S. Pat. Nos. 4,853,310; 5,087,540; and 3,816,118. A disadvantage of single layer constructions is that they tend suffer fatigue on repeated cycling and cannot be used in high speed systems.

Suitable charge generating materials for use in a single layer photoconductor and/or the charge generating layer of a bilayer photoconductor include azo pigments, perylene pigments, phthalocyanine pigments, squaraine pigments, and two phase aggregate materials. The two phase aggregate materials contain a light sensitive filamentary crystalline phase dispersed in an amorphous matrix.

The charge transport material transports the charge (holes or electrons) from the site of generation through the bulk of the film. Charge transport materials are typically either molecularly doped polymers or active transport polymers. Suitable charge transport materials include enamines, hydrazones, oxadiazoles, oxazoles, pyrazolines, triarylamines, and triarylmethanes. A suitable active transport polymer is polyvinyl carbazole. Especially preferred transport materials are polymers such as poly(N-vinyl carbazole) and acceptor doped poly(N-vinylcarbazole). Additional materials are disclosed in Borsenberger and Weiss, *Photoreceptors: Organic Photoconductors*, Ch. 9 Handbook of Imaging Materials, ed. Arthur S. Diamond, Marcel Dekker, Inc. 1991.

Suitable binder resins for the organic photoconductor materials include polyesters, polyvinyl acetate, polyvinyl chloride, polyvinylidene chloride, polycarbonates, polyvinyl butyral, polyvinyl acetoacetal, polyvinyl formal, polyacrylonitrile, polymethyl methacrylate, polyacrylates, polyvinyl carbazoles, copolymers of monomers used in the above-mentioned polymers, vinyl chloride/vinyl acetate/vinyl alcohol terpolymers, vinyl chloride/vinyl acetate/maleic acid terpolymers, ethylene/vinyl acetate copolymers, vinyl chloride/vinylidene chloride copolymers, cellulose polymers and mixtures thereof. Suitable solvents used in coating the organic photoconductor materials include nitrobenzene, chlorobenzene, dichlorobenzene, trichloroethylene, tetrahydrofuran, and the like.

Inorganic photoconductors such as, for example, zinc oxide, titanium dioxide, cadmium sulfide, and antimony sulfide, dispersed in an insulating binder are well known in the art and may be used in any of their conventional versions with the addition of sensitizing dyes where required. The preferred binders are resinous materials, including, but not limited to, styrenebutadiene copolymers, modified acrylic polymers, vinyl acetate polymers, styrene-alkyd resins, soya-alkyl resins, polyvinylchloride, polyvinylidene chloride, acrylonitrile, polycarbonate, polyacrylic and methacrylic esters, polystyrene, polyesters, and combinations thereof.

The release layer of this invention comprises a perfluorourethane preferably having the following structure:

$$C—[B—A—B—D]_x—[B—A]_y—B—C,$$

wherein A is derived from a di-functional perfluoroether, B is derived from a diisocyanate, C is derived from an amino functional silane, D is derived from a diol chain extender, x is an integer from 0 to 10, and y is an integer from 1 to 10. Preferably, x is 1 to 5 and y is 1 to 3. Preferably A has the formula $$—O—R_a—(R_F)_m—R_a—O—$$

wherein each $R_a$ is a divalent linking group, each $R_F$ independently is perfluorinated oxyalkylene group from 1 to 5, more preferably 1 to 2 carbon atoms, and m is an integer of from 5 to 50. More preferably A has the formula $$-O-CH_2(CH_2)_pCF_2(OCF_2)_m(OCF_2CF_2)_nOCF_2-O-$$

wherein m is an integer of from 5 to 25; n, is an integer of from 5 to 25; and p is an integer of from 0 to 3.

Preferably, B has the formula $$-\overset{O}{\overset{\|}{C}}-\overset{H}{\overset{|}{N}}-R_b-\overset{H}{\overset{|}{N}}-\overset{O}{\overset{\|}{C}}-$$

wherein $R_b$ is a divalent organic linking group. Preferably, C has the formula $$R_2-\overset{\overset{R_1}{|}}{\underset{\underset{R_3}{|}}{Si}}-(R)_d-N\begin{matrix}/ R_4\\ \backslash \end{matrix}$$

wherein, $R_1$, $R_2$, and $R_3$ are independently hydrogen, alkyl groups, preferably of 1 to 5 carbon atoms, aryl groups, and alkoxy groups, preferably of 1 to 5 carbon atoms, provided that at least one of $R_1$, $R_2$, and $R_3$, is a hydrogen or, more preferably an alkoxy group;

R is an alkylene group, alkenylene group, or arylene group;

$R_4$ is a hydrogen, alkyl groups of 1 to 5 carbon atoms, or an aryl group, and d is an integer up to 10, preferably 1 to 5.

Preferably, D has the formula $$-O-R_d-O-$$

wherein $R_d$ is a divalent organic linking group.

The inventive release layer may be formed by initially reacting a di-functional perfluoroether, such as a perfluoroether diol with a diisocyanate. An amino silane is then added to the mixture and the reaction is completed. Preferably, the perfluoroether diol and diisocyanate are further reacted with a diol chain extender before the addition of the silane. Preferably, the equivalent ratios of the reactants are 1 equivalent of di-functional perfluoroether:2 equivalents of diisocyanate: 1.5–1.9 equivalents of aminofunctional silane:0.1–0.5 equivalents of diol chain extender.

Suitable perfluoroether diols include, but are not limited to, those having the formula:

$$HO-R_a-(R_F)_m-R_a-OH$$

wherein $R_a$ is a divalent linking group, preferably a substituted or unsubstituted alkylene group of 1 to 5 carbon atoms or a carbon to oxygen bond, each $R_F$ independently is perfluorinated oxyalkylene group from 1 to 5, more preferably 1 to 2, carbon atoms, m is an integer of from 5 to 50. One preferred class of perfluoroether diols have the formula $$HO-CH_2(CH_2)_pCF_2(OCF_2)_m(OCF_2CF_2)_nOCF_2-OH$$

wherein m is an integer of from 5 to 25; n, is an integer of from 5 to 25; and p is an integer of from 0 to 3.

Any known diisocyante may be used. Suitable diisocyanates include but are not limited to 1,3-bis(1-isocyanato-1-methylethyl)-benzene; 1,12-diisocyanato-dodecane; 4,4'-methylenebis(cyclohexyl isocyanate); 4,4'-methylenebis (phenyl isocyanate); 4,4'-methylenebis(2,6-diethylphenyl isocyanate); 3,3'-dimethoxy-4,4'-biphenylenediisocyanate; 3,3'-dimethyldiphenylmethane-4,4'-diisocyanate; 1,4-phenylene diisocyanate; 1,4-diisocyanatobutane; 1,3-phenylenediisocyanate; m-xylene diisocyanate; 1,8-diisocyanatooctane; trans-1,4-cyclohexylene diisocyanate; 1,6-diisocyanatohexane; toluene 2,6-diiscyanate; and 1,5-diisocyanato-2-methylpentane. An especially preferred diisocyanate is 2,4-toluenediisocyanate.

Suitable silanes include those having the formula.

$$R_2-\overset{\overset{R_1}{|}}{\underset{\underset{R_3}{|}}{Si}}-(R)_d-N\begin{matrix}/ R_4\\ \backslash H\end{matrix}$$

wherein, $R_1$, $R_2$, and $R_3$ are independently hydrogen, alkyl groups, preferably of 1 to 5 carbon atoms, aryl groups, and alkoxy groups, preferably of 1 to 5 carbon atoms, provided that at least one of $R_1$, $R_2$, and $R_3$, is a hydrogen or, more preferably an alkoxy group;

R is an alkylene group, alkenylene group or arylene group;

$R_4$ is a hydrogen, an alkyl group of 1 to 5 carbon atoms, or an aryl group;

d is an integer up to 10, preferably 1 to 5.

Trialkoxysilyl-aminoalkanes are preferred. An especially preferred silane is 1 -triethoxysilyl-3-N-methylaminopropane.

Suitable chain extending diols include alkylene diols, arylene diols, alkenylene diols. Alkylene diols of 1 to 10 carbon atoms are preferred.

The above release layer is mechanically durable and very resistant to hydrocarbons which typically serve as toner carrier liquids. Preferably the thickness of the release layer is at least 0.1 μm. The maximum thickness is dependent on the photoconductor material, but preferably is 0.3 to 3 μm, more preferably 0.5 to 1.0 μm.

Optionally, the photoreceptor element of this invention may further comprise a barrier layer between the photoconductor layer and the release layer. The barrier layer protects the photoconductor layer from the toner carrier liquid and other compounds which might damage the photoconductor. The barrier layer also protects the photoconductive layer from damage that could occur from charging the photoreceptor element with a high voltage corona. The barrier layer, like the release layer, must not significantly interfere with the charge dissipation characteristics of the photoreceptor element and must adhere well to the photoconductive layer and the release layer without the need for adhesives. The barrier layer may be any known barrier layer, such as those disclosed in U.S. Pat. Nos. 4,439,509; 4,606,934; 4,595,602; 4,923,775; 5,124,220; 4,565,760; and WO95/02853.

Other layers, such as primer layers, substrate blocking layers, etc. as are known in the art may also be included in the photoreceptor element.

As is well understood in this area, substitution is not only tolerated, but is often advisable and substitution is anticipated on the compounds used in the present invention. As a means of simplifying the discussion and recitation of certain substituent groups, the terms "group" and "moiety" are used to differentiate between those chemical species that may be substituted and those which may not be so substituted. Thus, when the term "group," or "aryl group," is used to describe a substituent, that substituent includes the use of additional substituents beyond the literal definition of the basic group. Where the term "moiety" is used to describe a substituent, only the unsubstituted group is intended to be included. For example, the phrase, "alkyl group" is intended to include not only pure hydrocarbon alkyl chains, such as methyl, ethyl, propyl, t-butyl, cyclohexyl, iso-octyl, octadecyl and the like, but also alkyl chains bearing substituents known in the art, such as hydroxyl, alkoxy, phenyl, halogen atoms (F, Cl, Br, and I), cyano, nitro, amino, carboxy, etc. For example, alkyl group includes ether groups (e.g., $CH_3—CH_2—CH_2—O—CH_2—$), haloalkyls, nitroalkyls, carboxyalkyls, hydroxyalkyls, sulfoalkyls, etc. On the other hand, the phrase "alkyl moiety" is limited to the inclusion of only pure hydrocarbon alkyl chains, such as methyl, ethyl, propyl, t-butyl, cyclohexyl, iso-octyl, octadecyl, and the like. Substituents that react with active ingredients, such as very strongly electrophilic or oxidizing substituents, would of course be excluded by the ordinarily skilled artisan as not being inert or harmless.

By alkylene group is meant an alkyl group with two points of attachment formed by replacement of two hydrogen atoms with bonds (e.g. methylene from methane). By alkenylene group is meant an alkene group with two points of attachment formed by replacement of two hydrogen atoms with bonds (e.g. butenylene from butene). By arylene group is meant an aromatic group with two points of attachment formed by replacement of two hydrogen atoms with bonds (e.g. phenylene from benzene). By oxyalkylene group is meant a chain of atoms comprising alkylene groups and oxygen atoms.

Reasonable modifications and variations are possible from the foregoing disclosure without departing from either the spirit or scope of the invention as defined by the claims. Objects and advantages of this invention will now be illustrated by the following examples, but the particular materials and amounts thereof recited in these examples, as well as other conditions and details, should not be construed to unduly limit this invention.

EXAMPLES

All materials used in the following examples are readily available from standard commercial sources, such as Aldrich Chemical Co. Milwaukee, Wis., unless otherwise specified. All percentages are by weight unless otherwise indicated. The following additional terms and materials were used.

FC-113 is a fluorochemical solvent available from 3M Company, St. Paul, Minn.

Daracure 1173 catalyst is a UV photoinitiator and is available from Merck.

Desoto 952 is a UV-curable multifunctional acrylate monomer and is available from Desoto Corporation, Ill.

Dow Corning 176 is a tin catalyst and is available from Dow Corning Corp.

1-Triethoxysilyl-3-N-methylaminopropane has the formula shown below and is the precursor for the C portion of the compounds described herein. It was obtained from Hul Company as catalog item No. M8620.

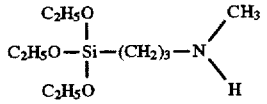

1,3-Butanediol and has the formula shown below and is the precursor for the D portion of the compounds described herein.

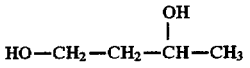

The perfluoroether diol used has a molecular weight of 1850 and has the structure shown below:

$$HO—CH_2CF_2(OCF_2)_{15}(OCF_2CF_2)_{13}OCF_2—OH.$$

The perfluoroether diester used has a molecular weight of 2000 and has the structure shown below:

$$C_2H_5OOCCH_2CF_2(OCF_2)_{15}(OCF_2CF_2)_{13}OCF_2COOC_2H_5.$$

2,4-Toluenediisocyanate has the formula shown below:

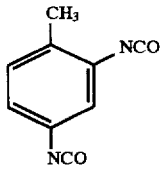

Sample 1 release coat formulation as disclosed in U.S. Pat. No. 4,600,673 based on Syl-Off™ 23 from Dow Corning.

Synthesis of Comparative Fluoro-Urethane (Sample 2)

As a comparative example, formulations incorporating an acrylate terminated fluorochemical polymer into a conventional UV-curable acrylate polymer were investigated.

The following is a general procedure to prepare these UV-cured samples. A 5% by weight solution of Desoto 952 (1.5 g), fluoro-modified acrylate urethane (3.5 g,), and 95 g of isopropyl alcohol was prepared. Daracure 1173 catalyst (0.1 g) was then added to this stock solution. The solution was coated with a #8 Meyer bar onto a piece of 3M Digital Matchprint™ organic photoreceptor substrate (without its standard silicone overcoat). The coated samples were cured by passing at a speed of 100 ft/min (30.5 m/min) under nitrogen using medium pressure mercury lamps.

Synthesis of Compound B—A—B (Sample 3—Comparative)

A solution of 20 g of fluorochemical solvent FC-113, 8.27 g of perfluoroether diol, 1.6 g of 2,4-toluenediisocyanate and one drop (0.02 g) of dibutyl tin dilaurate was mixed and stirred overnight (ca. 15 hours) at room temperature to form Compound B—A—B as a 33% solids solution. It was saved for use in subsequent coatings.

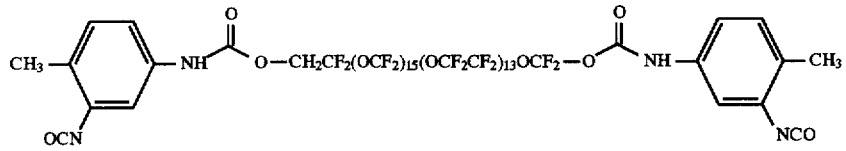

Compound B–A–B

Synthesis of Compound—(A—B)$_x$—(Sample 4—Comparative)

A solution of 40 g of fluorochemical solvent FC-113, 16.54 g of perfluoroether diol, 1.6 g of 2,4-toluenediisocyanate and one drop (0.02 g) of dibutyltin dilaurate was mixed and stirred overnight (ca. 15 hours) at room temperature to form polymer Compound—(A—B)$_x$— as a 31.2% solids solution. IR spectral analysis of the solution indicated the absence of unreacted isocyanate groups. The solution was saved for use in subsequent coatings.

A solution of 15 g of fluorochemical solvent FC-113, 5.0 g of perfluoroether diol, 0.89 g of2,4-toluenediisocyanate, and one drop (0.02 g) of dibutyltin dilaurate was prepared and stirred overnight (ca. 15 hours) at room temperature. A solution of, 0.97 g of 1-triethoxysilyl-3-N-methylaminopropane in 5.0 g of FC-113 was added to the solution. Stirring was continued for 1 hour. IR spectral analysis of the solution confirmed the absence of any unreacted isocyanate groups. The solution (25.54% solids) was saved for use in subsequent coatings.

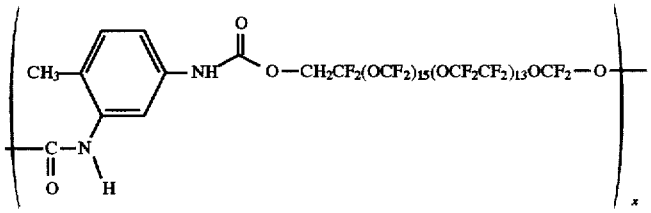

Compound A–B

Synthesis of Compound C—A'—C (Sample 5—Comparative)

A solution of 20 g of perfluoroether diester dissolved in 20 g of fluorochemical solvent FC-113 was slowly added to a solution of 3.86 g (2 equivalents) of 1-triethoxysilyl-3-N-methylaminopropane dissolved in 20 g of FC-113. The addition was carried out at room temperature. The reaction mixture was allowed to stir overnight at room temperature to form Compound C—A'—C as a 37.5% solution. IR spectral analysis was used to determine the progress of the reaction and confirmed the total replacement of the ester group (~1800 cm$^{-1}$) by the amide group (~1715 cm$^{-1}$). The solution was saved for use in subsequent coatings.

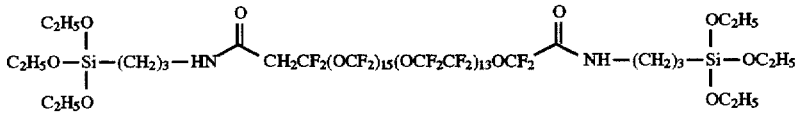

Compound C–A'–C

Synthesis of Perfluoroether Compound C—B—A—B—C (Sample 6)

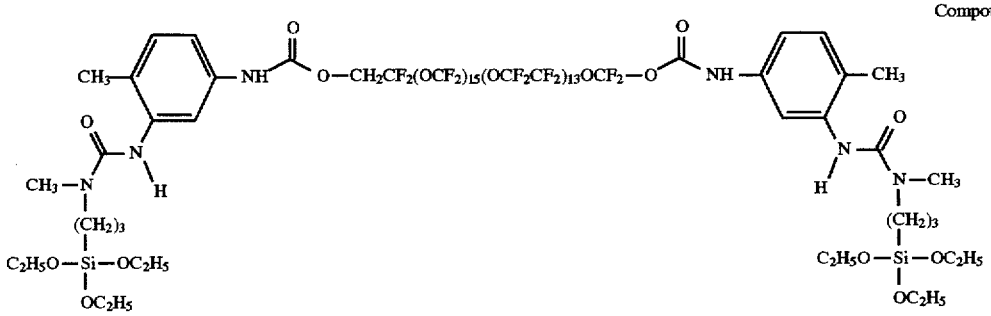

Compound C–B–A–B–C

Synthesis of Perfluoroether Compound C—[B—A—B—D]$_x$—B—A—B—C (Sample 7)

As noted above, addition of 1,3-butanediol results in the formation of a chain-extended oligimer. A chain-extended oligomer was prepared with x=1–10.

A solution of 20 g of fluorochemical solvent FC- 113, 8.27 g of perfluoroether diol, 1.6 g of 2,4-toluenediisocyanate, and one drop (0.02 g) of dibutyltin dilaurate was prepared and stirred overnight (ca. 15 hours) at room temperature. 1,3-Butanediol (0.07 g) was added to the cloudy solution. Stirring was continued for 0.5 hour after which 1.468 g of 1-triethoxysilyl-3-N-methylaminopropane was added to the solution. Stirring was maintained for another 1 hour. IR spectral analysis of the solution confirmed the absence of any unreacted isocyanate group. The solution (36.33% solids) was saved for use in subsequent coatings.

Coating of Perfluoroether Solutions

5% by weight solutions was prepared by diluting each of the above polymer stock solutions with the required amount of FC-113. One drop (0.01 g) of Dow Corning 176 tin catalyst was added to these 5% solutions. The solutions were then coated with a #8 Meyer bar onto a piece of organic photoreceptor. The photoreceptor (see U.S. Pat. No. 5,124,220) has an aluminized film base, a photoconductive layer having bis-5,5'-(N-ethyl-benzo[a]carbazolyl) phenylmethane (BBCPM) in Vitel™ PE-207 polyester resin (Goodyear), and a heptamethine indocyanine dye. An intermediate layer of 1,3-bis(3-[2,2,2-triaryloyloxymethyl) ethoxy-2-hydroxypropyl]-5,5-dimethyl-2,4-imidixolidinedione, Irgacure™ 184 photoinitiator (Ciba-Geigy), and fluorocarbon surfactant in ethanol was coated over the photoconductive layer, dried and cured. The overcoated photoconductor sheets were thermally cured at 80°–90° C. for 5–10 minutes and allowed to age at room temperature for two days prior to testing. The calculated coating thickness was approximately 0.9 μm The above made photoconductor constructions were subjected to the following tests:

Isopar L Resistance

To measure the durability of the release overcoats, an Isopar L soaked Q-tip was rubbed across the release overcoated organic photoconductor numerous times. The rubbed area was written on with a 3M non-permanent transparency pen. Dewetting of the pen's ink indicated the presence of release overcoat, while wetting indicated the overcoat had been rubbed off the organic photoconductor.

Peel Force

To evaluate the release property, 3M 202 masking tape, 1" (2.54 cm) wide, was applied to the surface of the release coated organic photoconductor constructions with a 15 lb. (6.8 kg) roller. The tape was peeled off at a rate of 20 inches/min (50.8 cm/min) for 10 sec. a 90 degree angle while the peel force between the tape and the release overcoat was being measured.

Toner Transfer

To study toner transfer to an intermediate transfer material, magenta toner was electroplated (500 Volts, 30 sec.) on 1.25"×4' (3.175 cm×10.16 cm) release overcoated organic photoconductor strips. The magenta toner was comprised of the solubilizing groups as described in the specification column 9, lines 49–56, U.S. Pat. No. 4,925,766 which is incorporated by reference. It was made at a charge direction level of 0.03 g Zr HEXCEM/g pigment and an organosol/pigment ratio of 4 using Sun Pigment Red 48:2 magenta pigment. The organosol was made at core/shell of 3 with PS 429 (Petrarch Systems, Inc., a polydimethylsiloxane with 0.5–0.6% methacryloxypropylmethyl groups, which is trimethylsiloxy terminated) and a core comprised of 70% ethyl acrylate and 30% methyl methacrylate. The organosol mean diameter was 239 nm, and the organosal was made at 10% solids. Air dried strips were placed toner side down onto a previously coated surface of Dow Corning 730 fluorosilicone and hand pressed at room temperature. The overcoated organic photoconductor was then peeled off to observe the quality of toner transfer.

The results shown in the Table below indicate that the release layers (Samples 6 and 7) of this invention have the desired combination good resistance to Isopar L, good durability, and good release properties. Sample 7 has the best combination of Isopar L rubbing resistance (high rub number), low peel force (good release) and good toner transfer. Sample 6 has the second best combination of properties. In short, the perfluoroether-urethane-silane system of this invention have good release with better durability.

Although the Isopar L rubbing resistance of the fluoro-urethane of Sample 2 is an improvement over Sample 1, high peel force indicates poor release. Samples 1 and 5 have a low peel force (good release) but poor Isopar L rubbing resistance. Finally, two perfluoroether-urethane systems (Samples 3 and 4) having similar composition and formulation to that described in U.S. Pat. No. 4,996,125 were evaluated. The results obtained for sample 4 had a high peel force and corresponding poor toner transfer while sample 3 had poor Isopar L rubbing resistance.

| Sample | Release Overcoat | Peel Force (oz/in) | Isopar L Resistance (number of rubs required for ink wetting) | Toner Transfer |
|---|---|---|---|---|
| 1 | Syl-Off™ 23 | 0.72 | <30 | complete |
| 2 | Fluoro-urethane; 94692-19 | 18.0 | ~80 | not available |
| 3 | Perfluoroether; A:B, 1:2 | 5.0 | ~10 | complete |
| 4 | Perfluoroether; A:B:A, 1:2:1 | 13.2 | <50 | none |
| 5 | Perfluoroether; A:C, 1:2 | 0.4 | ~10 | not available |
| 6 | Perfluoroether; A:B:C, 1:2:2 | 0.3–2.0 | ~50 | complete |
| 7 | Perfluorether; A:B:D:C, 1:2:0.1:1.9 | 0.5–2.0 | >150 | complete |

*A = perfluoroether diol, A' = perfluoroether diester, B = 2,4-toluene diisocyanate, D = 1,3-butanediol, C = N-methylaminopropyltriethoxysilane Reasonable modifications and variations are possible from the foregoing disclosure without departing from either the spirit or scope of the present invention as defined by the claims.

What is claimed is:

1. A photoreceptor element comprising an electroconductive substrate, a photoconductor layer, and a release layer comprising a perfluoroether urethane which is the reaction product of reactants comprising a) a di-functional perfluoroether, b) a diisocyanate, c) an amino functional silane, and, d) optionally, a diol chain extender.

2. The element of claim 1 wherein the reactants are used in equivalent ratios of 1 equivalent of di-functional perfluoroether:2 equivalents of diisocyanate: 1.5–1.9 equivalents of aminofunctional silane:0.1–0.5 equivalents of chain extender diol.

3. The element of claim 1 wherein the perfluoroether urethane has the following structure:

$$C—[B—A—B—D]_x—[B—A]_y—B—C,$$

wherein A has the formula $$—O—R_a—(R_F)_m—R_a—O—$$

wherein each $R_a$ is a divalent linking group, each $R_F$ independently is a perfluorinated oxyalkylene group from 1 to 5 carbon atoms, and m is an integer of from 5 to 50;

B has the formula

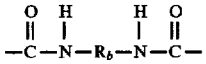

wherein $R_b$ is a divalent organic linking group;

C has the formula

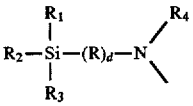

wherein, $R_1$, $R_2$, and $R_3$ are independently hydrogen, alkyl groups, aryl groups, and alkoxy groups, provided that at least one of $R_1$, $R_2$, and $R_3$, is a hydrogen or an alkoxy group;

R is an alkylene group, alkenylene group or arylene group;

$R_4$ is a hydrogen, alkyl groups of 1 to 5 carbon atoms, or an aryl group, and d is an integer up to 10;

D has the formula

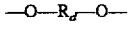

wherein $R_d$ is a divalent organic linking group; and x is an integer from 0to 10, and y is an integer from 1 to 10.

4. The element of claim 3 wherein x is 1 to 5 and y is 1 to 3.

5. The element of claim 1 wherein the di-functional perfluoroether has the formula:

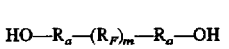

wherein each $R_a$ independently is a divalent linking group, each $R_F$ independently is a perfluorinated oxyalkylene group from 1 to 5 carbon atoms, and m is an integer of from 5 to 50.

6. The element of claim 5 wherein $R_a$ is a substituted or unsubstituted alkylene group of 1 to 5 carbon atoms or a carbon to oxygen bond.

7. The element of claim 1 wherein the diisocyanate is selected from the group consisting of 1,3 -bis(1-isocyanato-1-methylethyl)-benzene; 1,12-diisocyanatododecane; 4,4'-methylenebis(cyclohexyl isocyanate); 4,4'-methylenebis (phenyl isocyanate); 4,4'-methylenebis(2,6-diethylphenyl isocyanate); 3,3'-dimethoxy-4,4'-biphenylenediisocyanate; 3,3'-dimethyldiphenylmethane-4,4'-diisocyanate; 1,4-phenylene diisocyanate; 1,4-diisocyanatobutane; 1,3-phenylenediisocyanate; m-xylene diisocyanate; 1,8-diisocyanatooctane; trans-1,4-cyclohexylene diisocyanate; 1,6-diisocyanatohexane; tolylene 2,6-diisocyanate; and 1,5-diisocyanato-2-methylpentane, and 2,4-toluenediisocyanate.

8. The element of claim 1 wherein the silane has the formula.

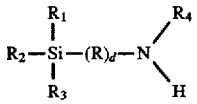

wherein, $R_1$, $R_2$, and $R_3$ are independently hydrogen, alkyl groups aryl groups, and alkoxy groups provided that at least one of $R_1$, $R_2$, and $R_3$, is a hydrogen or an alkoxy group;

R is an alkylene group, alkenylene group or arylene group;

$R_4$ is a hydrogen, an alkyl group of 1 to 5 carbon atoms, or an aryl group;

d is an integer up to 10.

9. The element of claim 1 wherein the silane is a trialkoxysilyl-aminoalkane.

10. The element of claim 1 wherein the diol chain extender is selected from alkylene diols, alkenylene diols, and arylene diols.

11. The element of claim 1 wherein the diol chain extender is an alkylene diol of 1 to 10 carbon atoms.

12. The element of claim 1 wherein the di-functional perfluoroether is a diol.

13. The element of claim 1 in which the release layer is from 0.1 to 3 μm thick.

14. The element of claim 1 further comprising a barrier layer between the photoconductor layer and the release layer.

15. A photoreceptor element comprising an electroconductive substrate, a photoconductor layer, and a release layer comprising a perfluoroether urethane having the structure:

wherein A has the formula

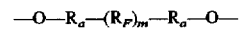

wherein each $R_a$ is a divalent linking group, each $R_F$ independently is perfluorinated oxyalkylene group from 1 to 5 carbon atoms, and m is an integer of from 5 to 50;

B has the formula

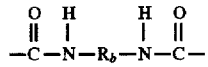

wherein $R_b$ is a divalent organic linking group;

C has the formula

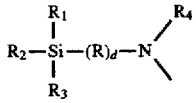

wherein, $R_1$, $R_2$, and $R_3$ are independently hydrogen, alkyl groups, aryl groups, and alkoxy groups, provided that at least one of $R_1$, $R_2$, and $R_3$, is a hydrogen or an alkoxy group;

R is an alkylene group, alkenylene group or arylene group;

$R_4$ is a hydrogen, alkyl groups of 1 to 5 carbon atoms, or an aryl group, and d is an integer up to 10;

D has the formula

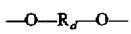

wherein $R_d$ is a divalent organic linking group; and x is an integer from 0 to 10, and y is an integer from 1 to 10.

* * * * *